US011598572B2

(12) United States Patent
Zago et al.

(10) Patent No.: US 11,598,572 B2
(45) Date of Patent: Mar. 7, 2023

(54) RETENTION BRACKET FOR REFRIGERATOR EVAPORATOR SYSTEM

(71) Applicant: WHIRLPOOL CORPORATION, Benton Harbor, MI (US)

(72) Inventors: Juan P. Zago, Monterrey (MX); Antonio Gatica Puga, Monterrey (MX)

(73) Assignee: Whirlpool Corporation, Benton Harbor, MI (US)

( * ) Notice: Subject to any disclaimer, the term of this patent is extended or adjusted under 35 U.S.C. 154(b) by 174 days.

(21) Appl. No.: 17/238,614

(22) Filed: Apr. 23, 2021

(65) Prior Publication Data

US 2022/0341653 A1 Oct. 27, 2022

(51) Int. Cl.
*F25D 23/00* (2006.01)
*F25B 39/02* (2006.01)

(52) U.S. Cl.
CPC ..... *F25D 23/006* (2013.01); *F25B 39/02* (2013.01)

(58) Field of Classification Search
CPC ..... F25D 23/006; F25B 39/02; F25B 39/022; F25B 2239/02; F28F 9/0075; F28F 9/013; F28F 9/0131; F28F 9/0138
See application file for complete search history.

(56) References Cited

FOREIGN PATENT DOCUMENTS

| | | | | |
|---|---|---|---|---|
| CN | 210801701 U | | 6/2020 | |
| CN | 108344206 B | | 7/2020 | |
| CN | 211876504 U | | 11/2020 | |
| EP | 927865 A1 | * | 7/1999 | ..... B21D 53/085 |
| KR | 19990027036 U | | 7/1999 | |

OTHER PUBLICATIONS

Foreign EP 927865 A1 (Year: 1999).*

* cited by examiner

*Primary Examiner* — Henry T Crenshaw
*Assistant Examiner* — Kamran Tavakoldavani
(74) *Attorney, Agent, or Firm* — Brooks Kushman P.C.

(57) ABSTRACT

A retention member for use in a refrigerator that includes an evaporator fin, a number of evaporator coils, a heater, and a bracket. The bracket includes a first portion extending in a first direction and defines a first aperture configured to receive a portion of a first evaporator coil of the number of evaporator coils. The bracket includes a second portion extending from the first portion to a first end in a second direction substantially transverse to the first direction. A tab extends from the second portion in the first direction. The tab is spaced apart from the first portion by a first distance to prevent or mitigate movement of the second evaporator coil of the number of evaporator coils.

20 Claims, 4 Drawing Sheets

RETENTION BRACKET FOR REFRIGERATOR EVAPORATOR SYSTEM

TECHNICAL FIELD

The present disclosure relates to a bracket for use in a refrigerator.

BACKGROUND

Refrigerators may circulate refrigerant through an evaporator to change the refrigerant from a liquid state to a gas state by an evaporation process in order to maintain a low temperature within the refrigerator. A refrigerator that includes a freezer may require a heat source such as a defrost heater to defrost portions of the freezer. The defrost heater may be formed by an electric wire that emits electromagnetic radiation to generate heat.

SUMMARY

According to one embodiment, a retention member for use in a refrigerator is provided. The refrigerator may include an evaporator fin, a number of evaporator coils, a heater, and a bracket. The bracket may include a first portion that may extend in a first direction and may define a first aperture configured to receive a portion of a first evaporator coil of the number of evaporator coils. The bracket may also include a second portion that may extend from the first portion to a first end in a second direction that may be substantially transverse to the first direction. A tab may extend from the second portion in the first direction. The tab may be spaced apart from the first portion by a first distance to prevent or mitigate movement of the second evaporator coil of the number of evaporator coils.

According to another embodiment, a refrigerator is provided. The refrigerator may include a heat element, an evaporator fin, a first evaporator coil, a second evaporator coil, and a retention bracket. The first evaporator coil and the second evaporator coil may each extend through the evaporator fin. The retention bracket may include a first portion and a second portion. The first portion may extend in a first direction and define a first aperture configured to receive a portion of the first evaporator coil. The second portion may extend in a second direction, that may be substantially transverse to the first portion, from the first portion to a first end. A tab may extend from the second portion along the first direction. The tab may be spaced apart from the first portion to prevent of mitigate movement of the second evaporator coil.

According to yet another embodiment, an assembly for use in a refrigerator is provided. The refrigerator may include a defrost heater, an evaporator fin, a first evaporator coil, a second evaporator coil, and a retention bracket. The first evaporator coil and the second evaporator coil may each extend through the evaporator fin. The retention bracket may include a first portion and a second portion. The first portion may extend in a first direction and define a first aperture configured to receive a portion of the first evaporator coil. The second portion may extend in a second direction, that may be substantially transverse to the first portion, from the first portion to a first end. A tab may extend from the second portion along the first direction. The tab may be disposed between an end of the second evaporator coil and the defrost heater.

DETAILED DESCRIPTION

Figure 1:
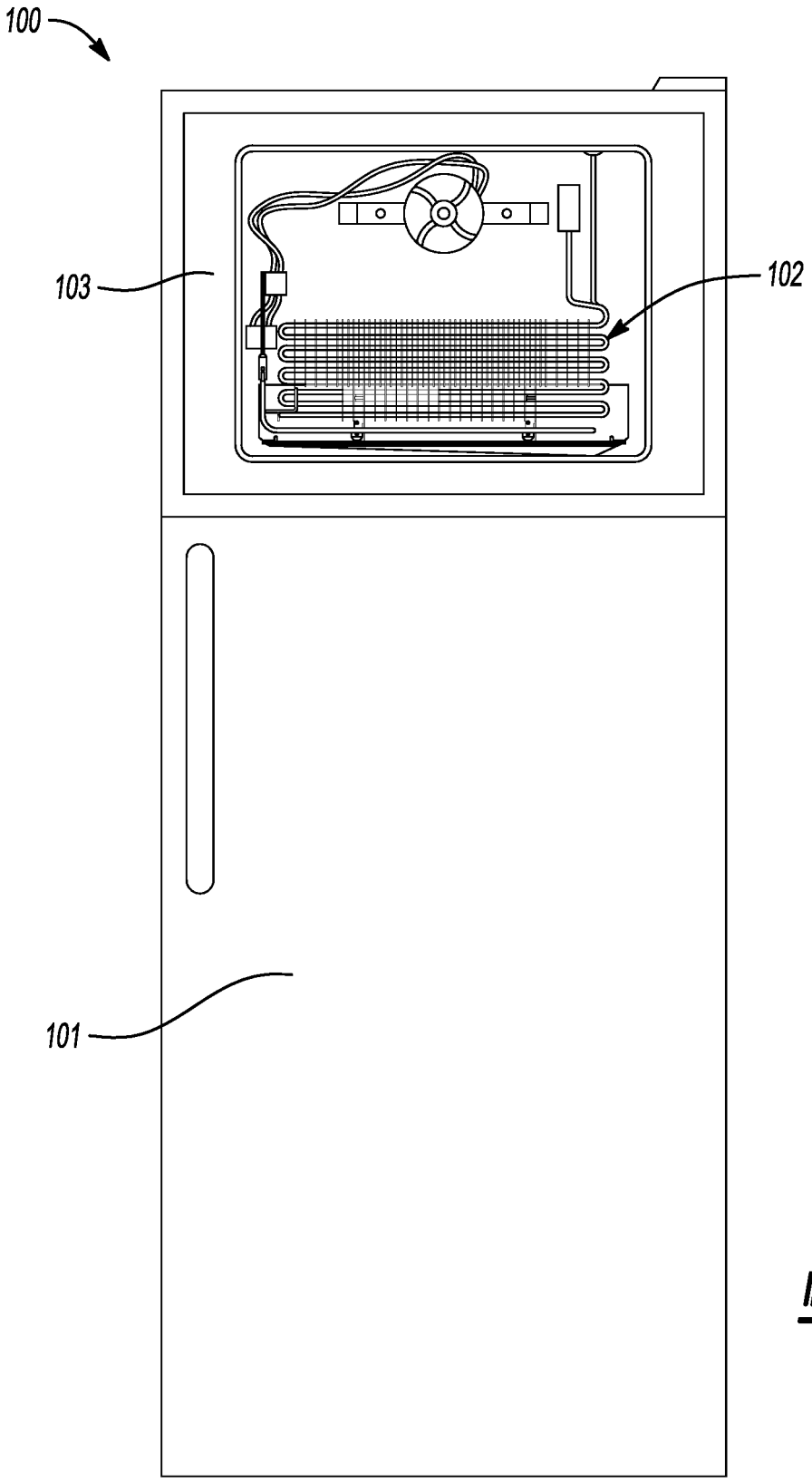
FIG. 1 illustrates a plan view of an exemplary refrigerator according to one or more embodiments.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

As used in the specification and the appended claims, the singular form "a," "an," and "the" comprise plural referents unless the context clearly indicates otherwise. For example, reference to a component in the singular is intended to comprise a plurality of components.

The term "substantially" or "about" may be used herein to describe disclosed or claimed embodiments. The term "substantially" or "about" may modify a value or relative characteristic disclosed or claimed in the present disclosure. In such instances, "substantially" or "about" may signify that the value or relative characteristic it modifies is within ±0%, 0.1%, 0.5%, 1%, 2%, 3%, 4%, 5% or 10% of the value or relative characteristic.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). The term "and/or" includes any and all combinations of one or more of the associated listed items.

Although the terms first, second, third, etc. may be used to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Referring generally to the figures, a refrigerator 100 is provided. The refrigerator 100 may include a heat exchanger assembly 102 provided with a heating element, such as a defrost heater 104, and an evaporator 106. The evaporator 106 may include a first evaporator coil 108 and a second evaporator coil 110. The first evaporator coil 108 and the second evaporator coil 110 may extend through a number of evaporator fins 112. A portion of the defrost heater 104 may be spaced apart from a portion 114 of the second evaporator coil 110 by a first distance D1.

A retention bracket 116 may be provided to retain or fix the position of the second evaporator coil 110 with respect to the defrost heater 104. The retention bracket 116 may include a first portion 118, that may extend in a first direction Z, and a second portion 120 that may extend in a second direction X that may be substantially transverse to the first direction Z. The first portion 118 may define a number of apertures 121 that may receive a portion of the first evaporator coil 108. The second portion 120 may extend from the first portion 118 to a first end 122 and a tab 124 may extend from the second portion 120 along the first direction Z. The tab 124 may be configured to prevent or mitigate movement of the second evaporator coil 110 along the second direction X so that the second evaporator coil 110 does not contact the defrost heater 104.

In one or more embodiments, the tab 124 may lie along the end portion 114 of the second evaporator coil 110 so that the position of the second evaporator coil 110 is fixed with respect to the second direction X. A first flange may be formed by a first sidewall 128 and a second sidewall 130 that may each extend from the first portion 118 in the second direction X. The first sidewall 128 and the second sidewall 130 may be spaced apart from one another so that the first flange receives one of the evaporator fins 112 so that the first flange fixes the first portion 118 with respect to a third direction Y.

An inner periphery of one or more of the aperture 121 defined by the first portion 118 may include a second flange 132 that may be inserted into an aperture 134 defined by the evaporator fin 112. As an example, the second flange 132 and the aperture 134 may be collectively configured to engage one another to form a force fit condition so that the first portion 118 is fixed with respect to the first, second, and third directions X, Y, Z. The aperture 121 defined by the first portion 118 and the aperture 134 defined by the evaporator fin 112 may each be elongated, meaning having a length that is greater than the width, and extend in a direction that is oblique to the first direction Z. In other words, the apertures 121, 134 may extend diagonally with respect to the first portion 118.

In one or more embodiments, the second portion 120 may include a third flange 136 that may extend in the first direction Z from the second portion 120. The third flange 136 may be formed by a third sidewall 138 and a fourth sidewall 140 that may be spaced apart from one another so that the third flange receives 136 portions of the second evaporator coil 110.

Figure 4:
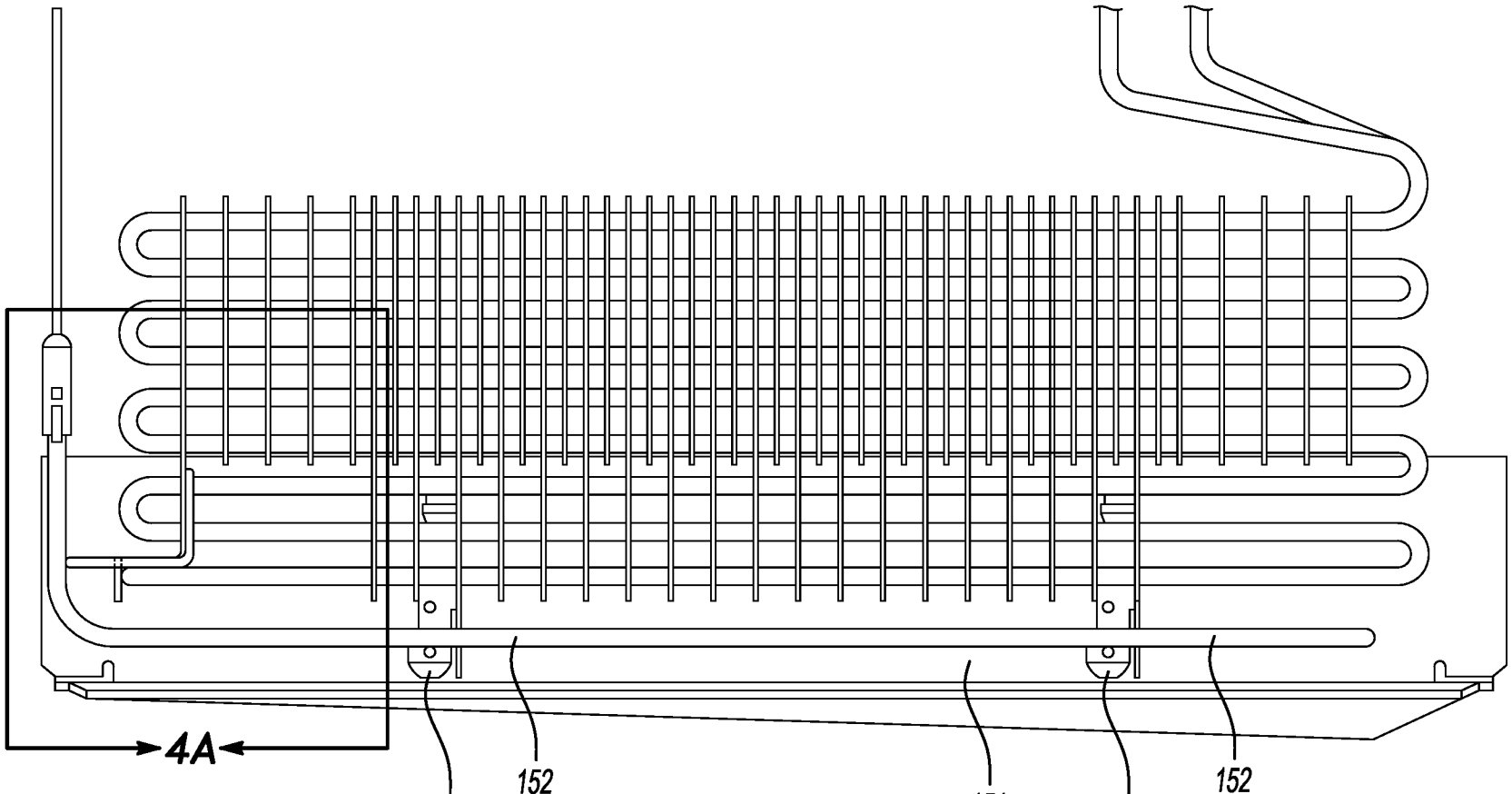
FIG. 4 illustrates a plan view of the exemplary assembly.

Fixing the second evaporator coil 110 with respect to the second direction X may prevent the second evaporator coil 110 from sliding and contacting the defrost heater 104 (FIG. 4). Under certain circumstances, the second evaporator coil 110 may be positioned too close e.g., less than 12 mm from the defrost heater 104. As an example, as the second evaporator coil 110 is assembled to the evaporator fin 112, the second portion 114 may be mispositioned so that it is less than a required distance from the defrost heater 104. As another example, the second evaporator coil 110 may slide or translate when the refrigerator 100 or refrigerator assembly 102 is shipped or moved to a desired location.

A minimum distance of approximately 8 mm may be required between the evaporator coils 108, 110 and the defrost heater 104 for a number of reasons. However, if the minimum distance is less than 12 mm, a protective member such as insulator may be used as required. For example, defrost heater 104 may be formed by a wire configured to provide radiant heat to the surrounding environment. Portions of the wire may be insulated so that heat is not radiated from the insulated portion. If the insulation deteriorates or tears away and the evaporator coils 108, 110 contact the uninsulated wire, the heat or electromagnetic radiation may damage the evaporator coils and refrigerant contained therein may leak from the evaporator coils 108, 110. The leaked refrigerant may lead to a thermal event. As another example, if the evaporator coils 108, 110 and the defrost heater 104 are not spaced sufficiently apart from one another, an electrical arc may form between those two parts.

FIG. 1 illustrates a plan view of the refrigerator 100 that includes the heat exchanger assembly 102. The heat exchanger assembly 102 includes the defrost heater 104 and an evaporator 106. As an example, the refrigerator 100 may be a top freezer, as illustrated, or another type of refrigerator such as side-by-side, bottom freezer, or a French door refrigerator. The refrigerator 100 may include a refrigerated compartment 101 and a freezer compartment 103. Here, an interior back panel and door for the freezer compartment 103 is not illustrated to show the heat exchanger assembly 102 within the refrigerator 100.

Figure 2:
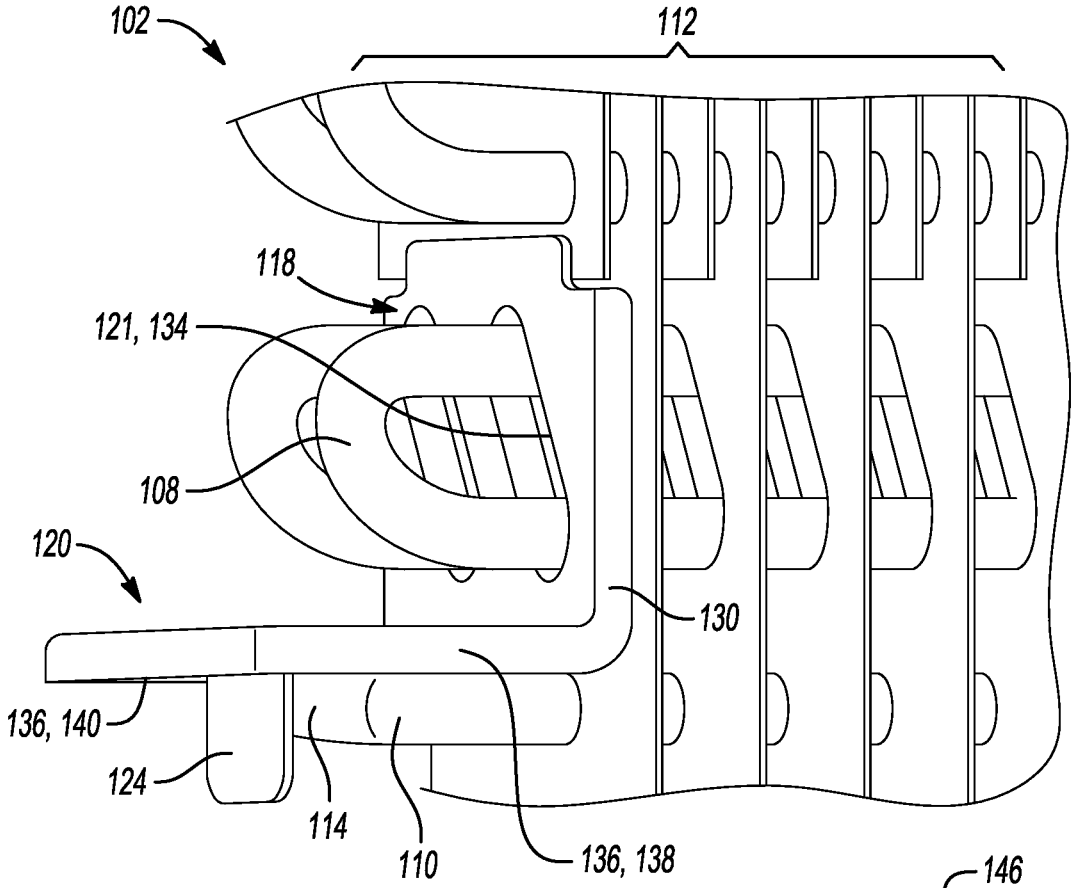
FIG. 2 illustrates a partial-perspective view of a portion of an exemplary assembly for use in the refrigerator.

FIG. 2 illustrates a perspective view of the heat exchanger assembly 102. The evaporator fins 112 may extend along the first direction Z and define a number of apertures 134. Portions of the first evaporator coil 108 may extend through the aperture 134 and the aperture 121 defined by the first portion 118 of the retention bracket 116. The second evaporator coil 110 may include a first tube section and a second tube section that may be connected by the end portion 114. The first tube section and the second tube section may be spaced apart from one another along the third direction Y. The tab 124 may lie against the end portion 114 so that the second evaporator coil 110 is fixed with respect to the second direction X.

Figure 3:
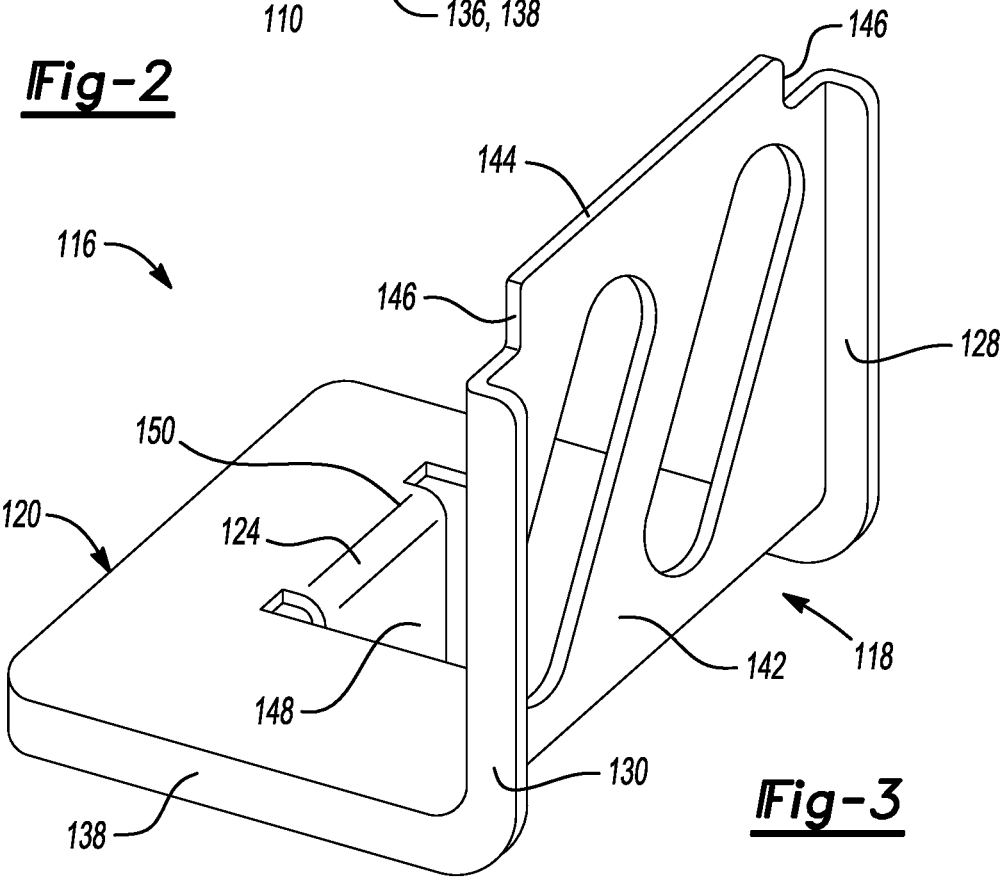
FIG. 3 illustrates a perspective view of an exemplary retention bracket.

FIG. 3 illustrates a perspective view of the retention bracket 116. The first portion 118 may include a mating wall 142 that may lie against the evaporator fin 112 when the retention bracket 116 is assembled to the assembly 102 (FIG. 3). The first and second sidewalls 128, 130 may extend from the mating wall 142 by approximately 5 mm. The mating wall 142 may include a tapered end 144 and a pair of notches 146 may be formed between the tapered end 144 and the first and second sidewall 128, 130. As an example, the tapered end may facilitate forming the bend between the first and second sidewalls 128, 130. The second portion 120 may define an aperture 148 and the tab 124 may be bent from an inner periphery 150 of the aperture 148. The sidewalls 128, 130, 138, 140 may provide additional cross-section and rigidity to the retention bracket when compared to an L-shaped bracket without such sidewalls. The rigidity provided by the sidewalls 128, 130, 138, 140 may prevent the retention bracket 116 from bending or distorting in response to forces applied by shifting of the second evaporator coil 110 (FIG. 2).

As an example, the sidewall 140 may lie against the defrost heater 104 so that the retention bracket 116 and the evaporator coils 108, 110 are braced against the retention bracket. In other words, the sidewall 140 and the tab 124 may be disposed between the defrost heater 104 and the end 114 of the second evaporator coil 110. In one or more embodiments, the sidewall 140 may be spaced apart from the defrost heater and if the second evaporator coil 110 shifts towards the defrost heater 104, the sidewall 140 may engage or contact the defrost heater to mitigate additional movement of the second evaporator coil.

FIG. 4 illustrates a plan view of the assembly 102 according to one or more embodiments. The assembly 102 may include a heat shield 151 and a number of mounting straps 154 that may be attached to the heat shield 151. The evaporator fins 112 disposed near the defrost heater 104 may not extend to or support portions of the first and second evaporator coils 108, 110. Because the second evaporator coil 110 is not engaged by some of the evaporator fins 112, the second evaporator coil 110 may be prone to shifting or being positioned incorrectly during assembly as compared to the other evaporator coils.

Figure 4A:
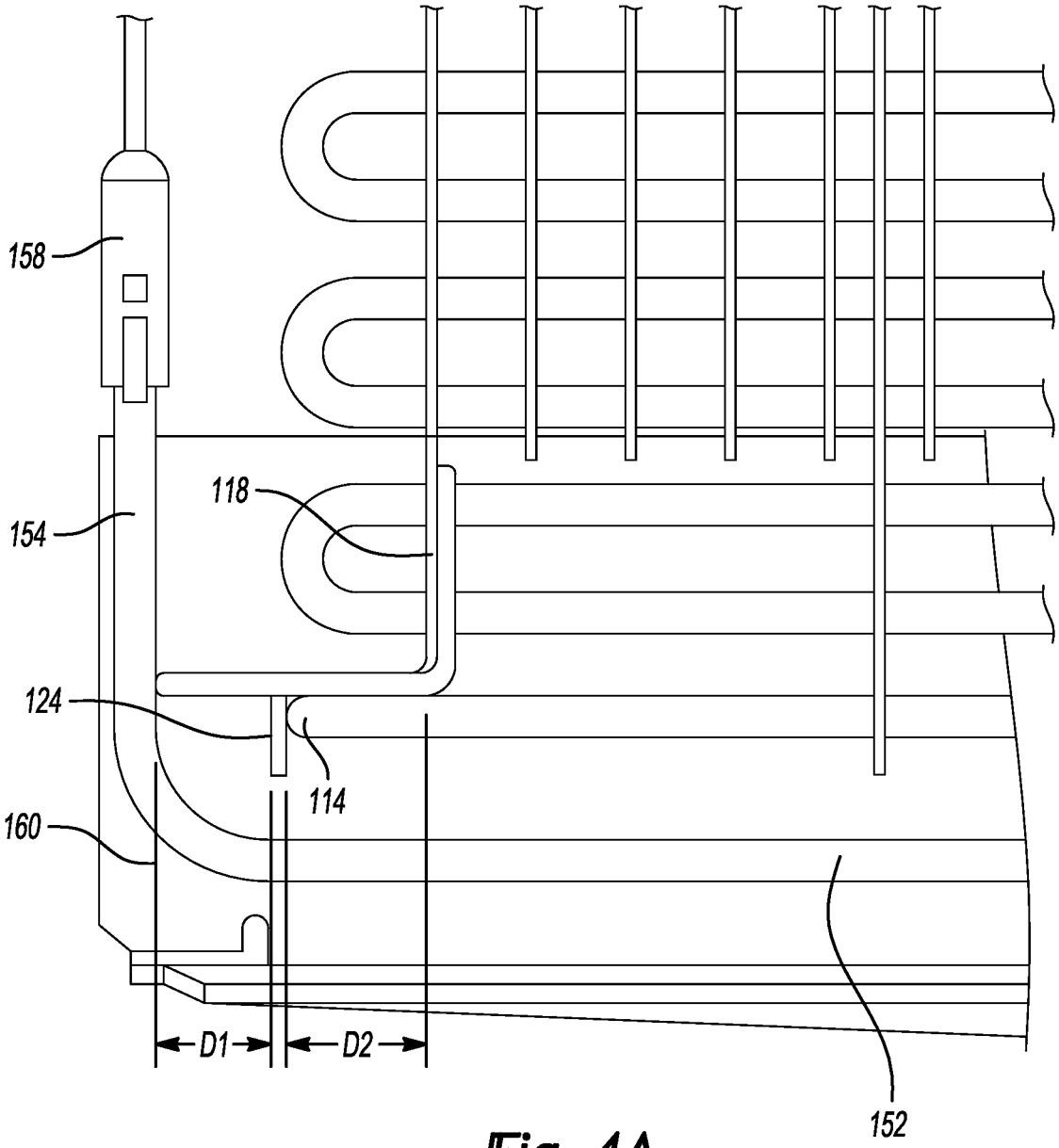
FIG. 4A illustrates a detail view taken along the lines 4-A in FIG. 4.

FIG. 4A illustrates a detail-plan view of the assembly 102 taken along the lines 4-A in FIG. 4. As mentioned above, the defrost heater 104 may be spaced apart from the end portion 114 of the second coil 110 by a first distance D1. As an example, the first distance D1 may be equal to or greater than 8 mm, provided an insulative member is provided, or the first distance may be equal to or greater than 12 mm. The tab 124 may be spaced apart from the first portion 118 or mating wall 142 (FIG. 3) by a second distance D2 that may be at least 20 mm or range between 20 mm and 31 mm. The defrost heater 104 may include a first portion 152 and a second portion 154. The first portion may extend in the second direction X and the second portion 154 may extend in the first direction Z. The second portion 154 may terminate at a heater connector insulation 158. Because the first portion 152 extends to a curved portion 160 and the second portion 154 extends therefrom, spacing the second portion 154 further away from the evaporator coils 108, 110 requires additional material and either lengthening the first portion 152 or the curved portion 160 of the defrost heater 104.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A retention member for use in a refrigerator provided with an evaporator fin, a number of evaporator coils, and a heater, the retention comprising:

a bracket including, a first portion extending in a first direction and defining a first aperture configured to receive a portion of a first evaporator coil of the number of evaporator coils, a second portion extending from the first portion to a first end in a second direction substantially transverse to the first direction, and a tab extending from the second portion along the first direction and spaced apart from the first portion by a first distance to prevent or mitigate movement of a second evaporator coil of the number of evaporator coils.

2. The retention member of claim 1, wherein the first portion includes a first flange provided with a first sidewall and a second sidewall each extending from the first portion in the second direction.

3. The retention member of claim 2, wherein the first flange is configured to fix the bracket to the evaporator fin with respect to a third direction substantially orthogonal to the first and second directions.

4. The retention member of claim 3, wherein the first sidewall and the second sidewall are spaced apart from one another and are configured to receive the evaporator fin.

5. The retention member of claim 4, wherein an inner periphery of the first aperture is formed by a second flange configured to support the first evaporator coil of the number of evaporator coils.

6. The retention member of claim 5, wherein the second flange is configured to be inserted into an aperture defined by the evaporator fin to form a form-fit condition between the first portion and the evaporator fin.

7. The retention member of claim 1, wherein the first aperture has an elongated shape and defines a longitudinal axis extending in a third direction oblique to the first direction.

8. The retention member of claim 1, wherein the second portion defines a second aperture having an inner periphery and the tab extends from a section of the inner periphery.

9. The retention member of claim 1, wherein the tab is configured to abut against the second evaporator coil of the number of evaporator coils.

10. A refrigerator comprising:

a heating element;

an evaporator fin; and a first evaporator coil and a second evaporator coil each extending through the evaporator fin;

a retention bracket including, a first portion extending in a first direction and defining a first aperture configured to receive a portion of the first evaporator coil, a second portion extending in a second direction, substantially transverse to the first portion, from the first portion to a first end, and a tab extending from the second portion along the first direction and spaced apart from the first portion to prevent or mitigate movement of the second evaporator coil.

11. The refrigerator of claim 10, wherein the tab lies along an end portion of the second evaporator coil.

12. The refrigerator of claim 11, wherein the first end of the second portion abuts the heating element.

13. The refrigerator of claim 11, wherein the tab is spaced apart from the first end by a first distance so that the end portion of the second evaporator coil is spaced apart from the heating element by at least 12 mm.

14. The refrigerator of claim 10, wherein the first portion lies along a portion of the evaporator fin.

15. The refrigerator of claim 14, wherein the first portion includes a flange formed by first and second sidewalls spaced apart from one another and configured to receive the evaporator fin.

16. The refrigerator of claim 10, wherein the second portion lies along a portion of the second evaporator coil.

17. The refrigerator of claim 16, wherein the second portion includes a flange formed by first and second sidewalls spaced apart from one another and configured to receive a portion of the second evaporator coil.

18. An assembly for use in a refrigerator comprising:

a defrost heater;

an evaporator fin;

a first evaporator coil and a second evaporator coil each extending through the evaporator fin; and a retention bracket including, a first portion extending in a first direction and defining a first aperture configured to receive a portion of the first evaporator coil, a second portion extending in a second direction, substantially transverse to the first portion, from the first portion to a first end, and a tab extending from the first portion along the first direction and disposed between an end of the second evaporator coil and the defrost heater.

19. The assembly of claim 18, wherein the tab lies along an end portion of the second evaporator coil.

20. The assembly of claim 19, wherein the first portion includes a flange, wherein the flange is configured to lie along one or more edges of the evaporator fin.

* * * * *